United States Patent [19]

Horsfall

[11] 4,140,628

[45] Feb. 20, 1979

[54] DENSE MEDIUM SEPARATION

[76] Inventor: David W. Horsfall, 38 8th Ave. Parktown North, Johannesburg, Transvaal, South Africa

[21] Appl. No.: 811,902

[22] Filed: Jun. 28, 1977

Related U.S. Application Data

[63] Continuation of Ser. No. 712,048, Aug. 6, 1976, abandoned.

[30] Foreign Application Priority Data

Aug. 8, 1975 [ZA] South Africa ..... 75/5123

[51] Int. Cl.[2] ..... B03B 5/34

[52] U.S. Cl. ..... 209/39; 209/172.5; 209/211

[58] Field of Search ..... 209/39, 172.5, 211, 209/12

[56] References Cited

U.S. PATENT DOCUMENTS

| | | | |
|---|---|---|---|
| 2,724,503 | 11/1955 | Fontein | 209/211 |
| 2,726,764 | 12/1955 | Fontein | 209/172.5 |
| 2,889,925 | 6/1959 | Fontein | 209/172.5 |

*Primary Examiner*—Ralph J. Hill
*Attorney, Agent, or Firm*—Young & Thompson

[57] ABSTRACT

A method for recovering magnetic dense medium particles from a suspension containing these particles and other less dense particles includes the steps of subjecting the suspension to at least a single stage high relative density separation to form a first fraction containing substantially only dense medium particles and a second fraction containing the bulk of the other particles and some dense medium particles, and subjecting the second fraction to a magnetic separation for recovery of the remaining dense medium particles. Each stage of the high relative density separation is effected in a cyclone. The suspension may be the overflow or the underflow from a dense medium process for the beneficiation of coal fines.

2 Claims, 1 Drawing Figure

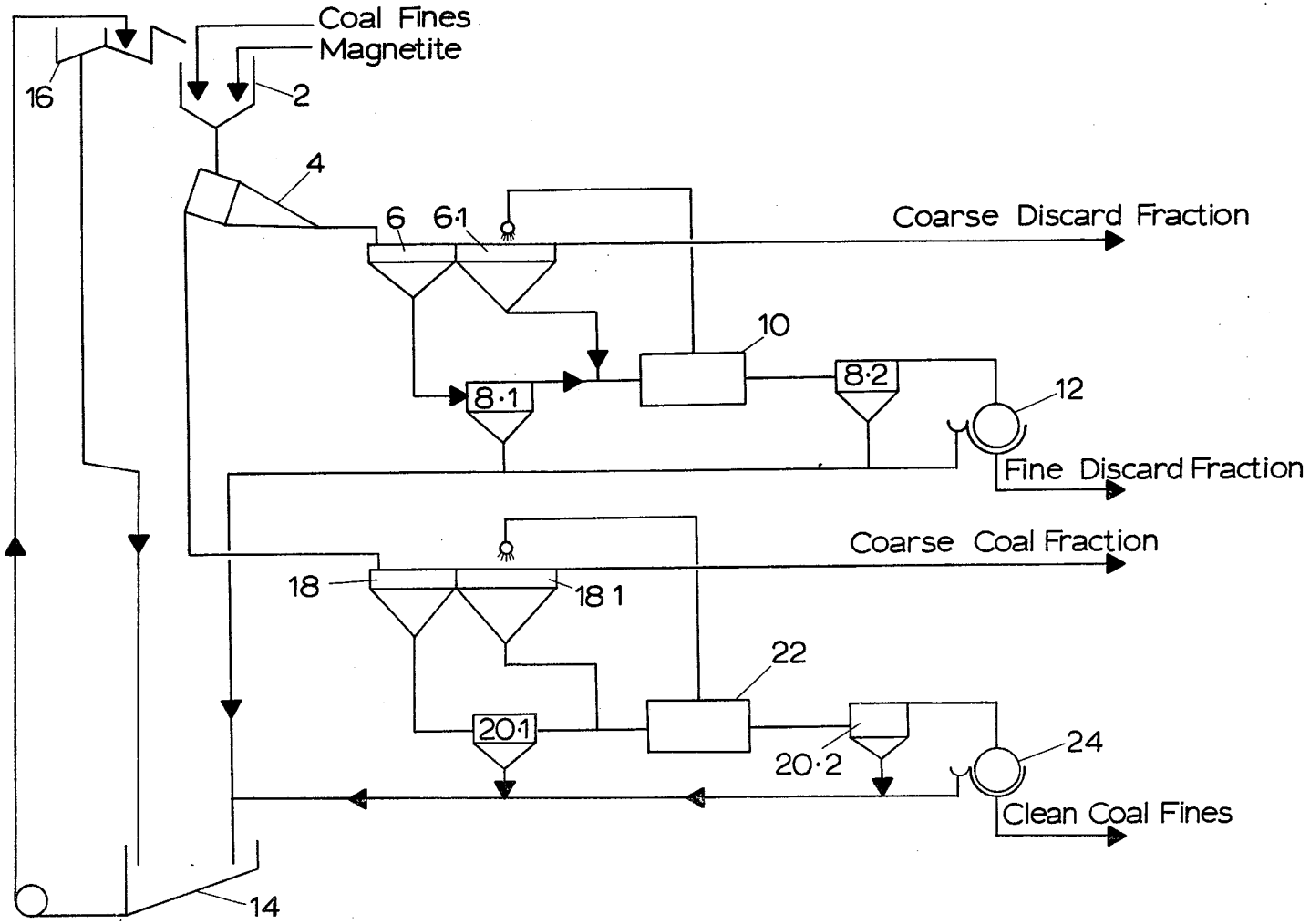
Coal Fines
Magnetite
2
4
6
6·1
Coarse Discard Fraction
10
8·1
8·2
12
Fine Discard Fraction
16
Coarse Coal Fraction
18
18 1
22
20·1
20·2
24
Clean Coal Fines
14

DENSE MEDIUM SEPARATION

This is a continuation, of application Ser. No. 712,048, filed Aug. 6, 1976, now abandoned.

This invention relates to dense medium separation wherein magnetic particles are used to form the dense medium.

Dense medium separation is a well known technique for separating particulate solids of different densities in a mixture. The dense medium is a suspension of dense particles in a liquid. The mixture of particles for separation is mixed with the suspension, and the different particles allowed to sink or float. The operation may for example be effected in a cyclone. When coarse particles are involved there is little problem in separating the particles in the underflow and overflow from the dense medium by simple screening.

When dense medium separation is used for particles over 1000μ, the greater part of the medium may be recovered for immediate re-use by screening alone. The magnetite particles adhering to the washed products may be rinsed off and the diluted magnetite suspension so created cleaned and concentrated in magnetic separators.

When attempting to wash particulate material nominally less than 1000μ, efficient separation of the cleaned particles from the medium is not so readily effected by simple screening. Moreover, because of the large surface area of the cleaned particles, adherence of magnetite is a severe problem. Consequently, in washing plants attempting to clean-1000μ particles, it has been proposed that the entire separation of the cleaned products from the medium be carried out by magnetic separation.

For acceptable recovery of the dense medium however large separation areas and considerable dilution of the suspensions is required. This is a costly step.

According to the invention a process wherein a particulate material is separated by means of a dense medium suspension made up of magnetic particles into high and low density fractions and the dense medium is recovered from the fractions by screening and washing to yield a first product recovered from the high density fraction and a second product recovered from the low density fraction, has the improvement that at least one of the products is subjected to a hydrocyclone separation to yield a dense fraction containing substantially only dense medium particles and a light fraction containing substantially all of the other particles and some dense medium particles and recovering the dense medium particles from the light fraction by means of a magnetic separation, the dense fraction and the recovered particles being utilized to make up the dense medium suspension.

A wide angle cyclone, i.e. a cyclone the cone angle of which is in the range 60° to 180° if preferred for use in treating the product. A cyclone with such an angle is well adapted to effect a density separation rather than a size separation or classification.

The method of the invention may be used in the separation of fine coal particles from a dense medium wherein the dense particles are magnetite. For example, it may be used to treat the overflow from a dense medium process for the beneficiation of coal fines.

In this case the method may also be used to treat the underflow, i.e. to separate the magnetite particles from the discard particles.

The invention is discussed further with reference to the attached flow sheet of a plant intended to beneficiate coal fines.

Referring to the flow sheet, raw coal fines for beneficiation are mixed with an aqueous suspension of magnetite in a tank 2. The mixture is fed to a cyclone 4 for a conventional dense medium beneficiation of the coal fines. The underflow from the cyclone 4 comprises a suspension of discard and magnetite particles, and the overflow a mixture of washed coal fines and magnetite particles. Both the underflow and overflow are subjected to further similar treatment for separation of the magnetite particles from the other less dense particles (coal or discard) present therein as follows:

The underflow from the cyclone 4 is fed to a screening stage 6 for removal of any coarse discard fractions (i.e. exceeding a predetermined size, say 1000μ). The overflow from the screening stage 6 comprising the coarse discard fraction is led away, and the underflow is fed to a first cyclone 8.1. The overflow from the cyclone 8.1 is fed to a dewatering stage 10 and then to a second cyclone 8.2. The screening stage 6 includes a rinsing portion 6.1 which is fed with water from the dewatering stage 10. The underflow from the rinsing portion 6.1 is added to the overflow from the cyclone 8.1 before it enters the dewatering stage 10. The underflow from each cyclone 8.1, 8.2 is adjusted to form a first fraction containing essentially only magnetite particles. This fraction is recycled to the tank 2 via an overdense tank 14 and load box 16. The overflow from the second cyclone 8.2 forms a second fraction containing the bulk of the discard particles and some dense medium particles. This second fraction is fed to a magnetic separator 12 for recovery of the remaining magnetite particles. The magnetite recovered is recycled from the magnetic separator 12 to the tank 2 via the overdense tank 14 and load box 16. The fine discard is led away.

The overflow from the cyclone 4 is treated similarly. It is fed to a screening stage 18 for removal of any coarse coal fractions (i.e. exceeding a predetermined size, say 1000μ). The overflow from the screening stage 18 comprising the coarse coal fractions is led away, and the underflow is fed to a first cyclone 20.1. The overflow from this cyclone 20.1 is fed to a dewatering stage 22 and then to a second cyclone 20.2. The screening stage 18 includes a rinsing portion 18.1 which is fed with water from the dewatering stage 22. The underflow from the rinsing portion 18.1 is added to the overflow from the cyclone 20.1 before it enters the dewatering stage 22. The underflows from the cyclones 20.1 and 20.2 containing substantially magnetite particles only, are recycled to the tank 2 via the overdense tank 14 and load box 16. The overflow from the cyclone 20.2 contains the bulk of the coal particles and some magnetite particles. It is fed to a magnetic separator 12 for recovery of the magnetite particles. The recovered magnetite is recycled to the tank 2 via the overdense tank 14 and load box 16, and the cleaned coal fines are led away.

The cyclones 8.1, 8.2, 20.1 and 20.2 are all wide angle cyclones, i.e. having a cone angle in the range 60°–180°.

The magnetite particles used for forming the dense medium are of conventional size for such processes, not exceeding 100 microns.

The coal fines to which the process is particularly applicable are those having a particle size not exceeding of the order of 1000 microns, in particular those in which the majority have a particle size less than 500 microns. Particles of this order of size being recalcitrant to separation techniques such as froth flotation, require dense medium separation, and accordingly magnetic separation of the magnetite particles from the coal and discard particles in the overflow and underflow respectively.

In a number of tests a substantially pure underflow (i.e. containing little contaminating coal) was obtained when aqueous suspensions of coal particles and magnetite particles of the order of the above sizes were fed to cyclones having cone angles of 160° and 180°.

Preceding magnetic separation treatment of the underflow and overflow from the dense medium beneficiation with high specific gravity separations has the advantage that the loads on the magnetic separators are significantly reduced. Thus smaller capacity, and accordingly less expensive, magnetic separators may be used.

I claim:

1. A process for separating first and second particulate materials of different density by means of a dense medium suspension made up of magnetic particles, comprising forming an admixture of said first and second materials with said suspension of magnetic particles, densimetrically separating said admixture into a high density first fraction, containing substantially only said first material and magnetic particles and a low density second fraction containing substantially only said second material and magnetic particles, screening and washing said first fraction to remove therefrom coarse particles of said first material leaving a fine remainder, screening and washing said second fraction to remove therefrom coarse particles of said second material leaving a fine remainder, hydrocyclonically separating said fine remainder of said screened and washed first fraction into a high density third fraction containing substantially only magnetic particles and a low density fourth fraction containing substantially only said first material and magnetic particles, magnetically separating said fourth fraction into a fifth fraction containing substantially only magnetic particles and a sixth fraction containing substantially only said first material, hydrocyclonically separating said fine remainder of said screened and washed second fraction into a high density seventh fraction containing substantially only magnetic particles and a low density eighth fraction containing substantially only said second material and magnetic particles, magnetically separating said eighth fraction into a ninth fraction containing substantially only magnetic particles and a tenth fraction containing substantially only said second material, and returning said third, fifth, seventh and ninth fractions to said admixture.

2. A process as claimed in claim 1, in which said second material is coal.

* * * * *